United States Patent [19]

Cavil et al.

[11] Patent Number: 4,592,818

[45] Date of Patent: Jun. 3, 1986

[54] CATHODIC PROTECTION SYSTEM

[75] Inventors: David T. Cavil, Menomonee Falls; William R. Krueger, West Allis, both of Wis.

[73] Assignee: Outboard Marine Corporation, Waukegan, Ill.

[21] Appl. No.: 531,420

[22] Filed: Sep. 12, 1983

[51] Int. Cl.[4] ..... C23F 13/00

[52] U.S. Cl. ..... 204/196; 204/147; 323/282; 323/290

[58] Field of Search ..... 204/147, 148, 196, 197; 323/282, 290

[56] References Cited

U.S. PATENT DOCUMENTS

| | | | |
|---|---|---|---|
| 2,963,413 | 12/1960 | Sabins | 204/196 |
| 3,098,026 | 7/1963 | Anderson | 204/147 |
| 3,127,337 | 3/1964 | Conger et al. | 204/196 |
| 3,142,631 | 7/1964 | Woodley | 204/147 |
| 3,209,237 | 9/1965 | Wiest | 323/290 |
| 3,284,695 | 11/1966 | Weisz | 323/282 |
| 3,448,033 | 6/1969 | Husock | 204/196 |
| 3,497,794 | 2/1970 | Fredrickson et al. | 323/282 |
| 3,670,233 | 6/1972 | Zellmer et al. | 323/282 |
| 4,017,745 | 4/1977 | McMahon | 323/282 |
| 4,136,309 | 1/1979 | Galberth et al. | 204/196 |
| 4,350,948 | 9/1982 | Meroni | 323/290 |
| 4,513,360 | 4/1985 | Ikenoue et al. | 323/290 |

OTHER PUBLICATIONS

Fitzgerald et al., *Basic Electrical Engineering*, 2nd. ed., 1957, pp. 157–160, 354.

*Primary Examiner*—T. Tung

*Attorney, Agent, or Firm*—Michael, Best & Friedrich

[57] ABSTRACT

In an impressed current cathodic protection system for a boat and/or its propulsion system the boat battery is connected to a switching type power converter which supplies the anode higher current at lower voltage than taken from the battery. The voltage on the anode is regulated to be constant or to be fixed relative to the voltage at a reference half cell. With either arrangement, the voltage drop across a reference resistor can be applied to an op amp to turn on a transistor to connect an alternate power source to the anode. The voltage across the resistor is regulated by the power converter chip so the chip also regulates the alternate source to prevent excessive voltage on the anode.

14 Claims, 4 Drawing Figures

CATHODIC PROTECTION SYSTEM

FIELD OF THE INVENTION

This invention relates to impressed current cathodic protection systems.

BACKGROUND OF THE INVENTION

The use of the battery in a boat to supply current to a cathodic protection system is old. A substantial portion of the power drawn from the battery is wasted and the battery is discharged more rapidly than the system requirements alone would necessitate. It is to reduce battery drain to prolong the discharge the battery.

SUMMARY OF THE INVENTION

An important feature of this invention is the provision of an impressed current cathodic protection system for a boat and/or its propulsion system in which protection system a switching type power converter is connected to the boat battery and supplies higher current at lower voltage to the anode than taken from the boat battery. This markedly increases the life of the battery between charges.

Another feature is to reference the anode voltage relative to a half-cell voltage to maximize conditions for the type of half cell used (i.e. using a material more or less noble than the structure to be protected).

A further feature is to supply a constant voltage to the anode and this requires an anode having a constant surface characteristic. With such a circuit the power converter chip output is amplified and applied to the anode through a current sensing resistor and the anode voltage is also applied to the error sensing amplifier in the chip to adjust the voltage relative to a fixed reference voltage. Still another feature of this invention is the use of an alternate power source (solar. wind etc.) with the fixed anode voltage circuit. In this version the voltage drop across the resistor is applied to the inputs of an operational amplifier (op amp) to cause it to become a sink in the base circuit of a transistor so the alternate source, if effective. supplies the sink current and the transistor turns on to connect the alternate source to the anode. Since the current to the resistor is regulated by the power converter chip and the voltage drop across the resistor is applied to and regulates the op amp, the chip regulates the op amp and the transistor to control the voltage applied to the anode.

This invention is not limited to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DETAILED DESCRIPTION OF THE DRAWINGS

Figure 1:
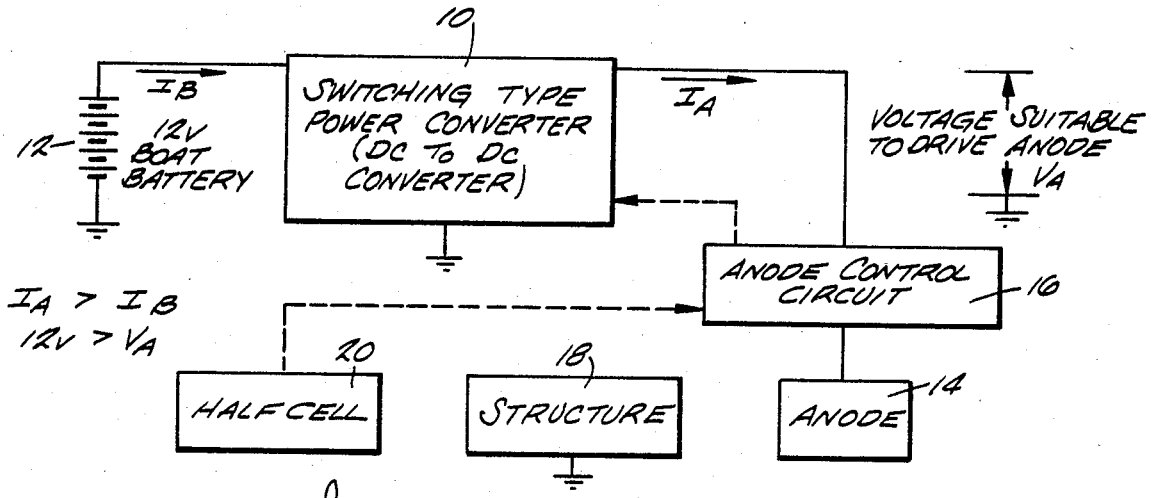
FIG. 1 is a schematic block diagram of the scheme.

FIG. 1 is a block diagram depicting the essentials of an impressed current cathodic protection system utilizing a switching type power converter 10 connected to the 12 volt boat battery 12 and supplying a smaller voltage $V_A$ to anode 14. The switching type power converter 10 will supply to anode 14 a current $I_A$ which is greater than the current $I_B$ drawn from the battery. This is possible because the converter converts power and if the Voltage $V_A$ is less than 12 volts, then the current $I_A$ can be greater than the current $I_B$ drawn from the battery. The current applied to the anode 14 is regulated by the anode control circuit 16 at a level protecting the structure (motor and/or boat) 18 in accordance with the signal derived from the half cell 20 which feeds back to the anode control circuit.

Figure 2:
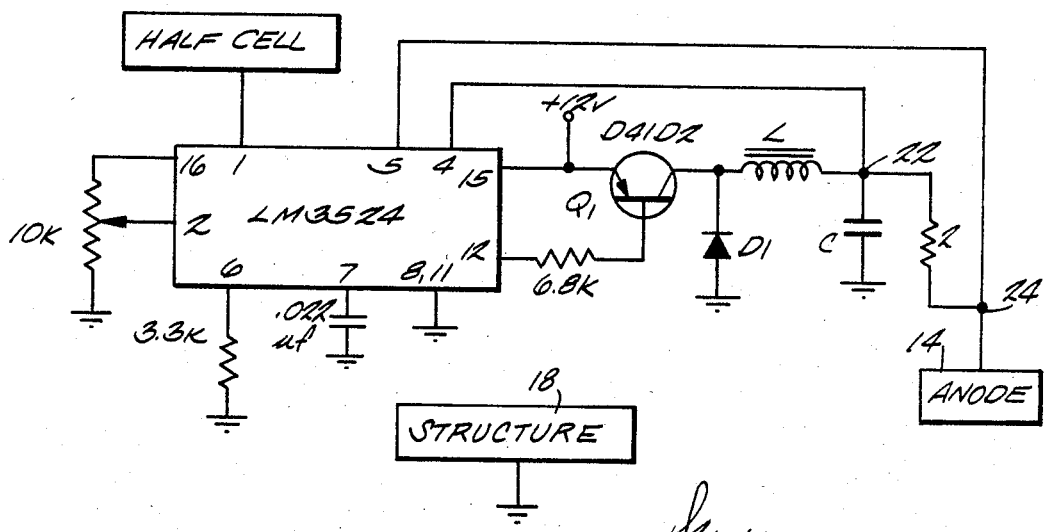
FIG. 2 is a circuit diagram showing how the power converter chip is connected to carry out the scheme of FIG. 1 with a half cell more noble than the protected structure.

A form of this circuit is shown in FIG. 2 in which the circuit components and values are indicated where important. If a value is not indicated, the actual value to be used to suit the particular installation can be easily determined with a few "cut and try" tests. This is simply a mater of trying a few logical values.

In FIG. 2 the switching type power converter is an LM3524 regulating pulse width modulator chip manufactured by National Semiconductor, or an equivalent chip. The pin numbers as designated on FIG. 2 follow standard designations.

The reference voltage developed in the conVerter is at pin 16 which is connected to ground through a 10K potentiometer permitting adjustment of the voltage applied to pin 2 which is the non-inverting (+) input of the error amplifier included in the 3524 converter chip. The inverting (−) input to the error amplifier is at pin 1 which is connected to the half cell which, in this case, is selected to be more noble than the structure. Thus, the half cell can be silver-silver chloride, carbon or calomel. Pins 4 and 5 are the non-inverting and inverting connections to the current limiting amplifier and are connected to protect against a shorted anode by measuring the voltage drop across the 2 ohm resistor between junctions 22, 24, respectively connected to pins 4 and 5. The 12 volt boat battery is connected to converter pin 15 and also to transistor $Q_1$. The base of the transistor $Q_1$ is connected to the collector of a transistor in the power converter via pin 12 and the 6.8K resistor.

The output of transistor $Q_1$ will be a pulsed output giving an average voltage over a time base commensurate with the dictates of the voltage sensed at pin 1 relative to the reference voltage at pin 2. The pulses are smoothed and the power dlivery made uniform by the LC circuit. The smoothed voltage is applied to the anode 14 through the current sensing 2 ohm resistor. This arrangement can provide 100 milliamps of anode current while drawing less than 40 milliamps from the battery. The voltage applied to the anode will be about 2½ volts compared to the 12 volt battery voltage. To protect an aluminum structure with a silver-silver chloride half cell the potential at the half cell should be about 950 millivolts relative to the structure and this establishes the control voltage at pin 1. As the voltage at pin 1 deviates from 950 mv, the output to the anode is adjusted as necessary to maintain the desired protection by bringing the voltage back to 950 mv.

Figure 3:
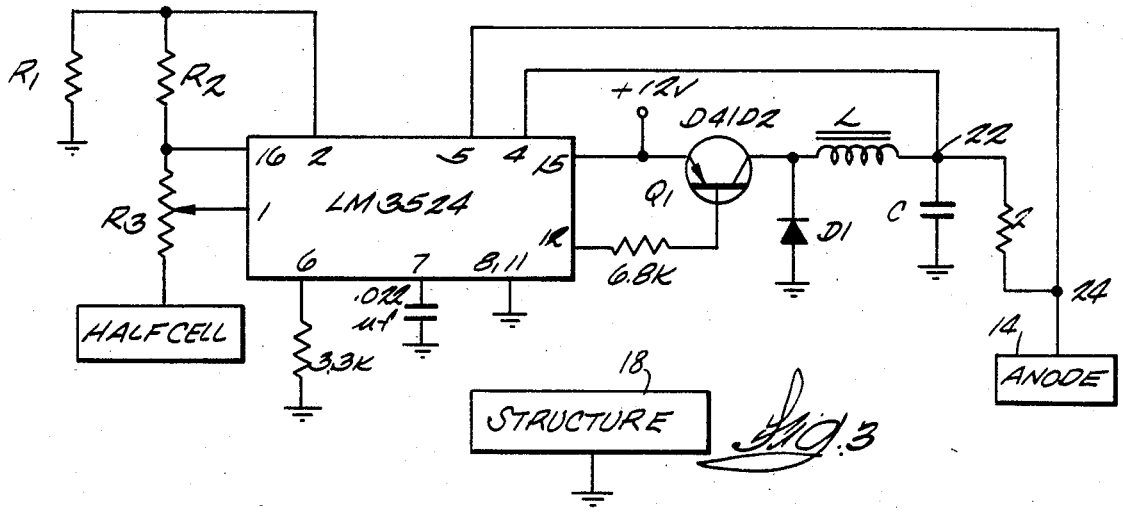
FIG. 3 is similar to FIG. 2 but is for use with a half cell less noble than the structure with consequent circuit changes at pins 1 and 2 of the chip.

Compared to FIG. 2, the difference in FIG. 3 is that the reference voltage at 16 on the LM3524 chip is connected to the half cell through a potentiometer adjusted to give the desired voltage at the inverting input 1 of the error amplifier. The voltage divider $R_1$ and $R_2$ establishes a reference voltage on pin 2 (non-inverting) of the error amplifier. With a zinc half cell (less noble than aluminum) the initial voltage on pin 1 would be about −100 millivolts and would rise to zero as the half cell comes to the desired level. This will cause the converter to adjust the voltage on the anode to the desired level. With the conditions around the half cell changing, the voltage on the anode will also change.

Figure 4:
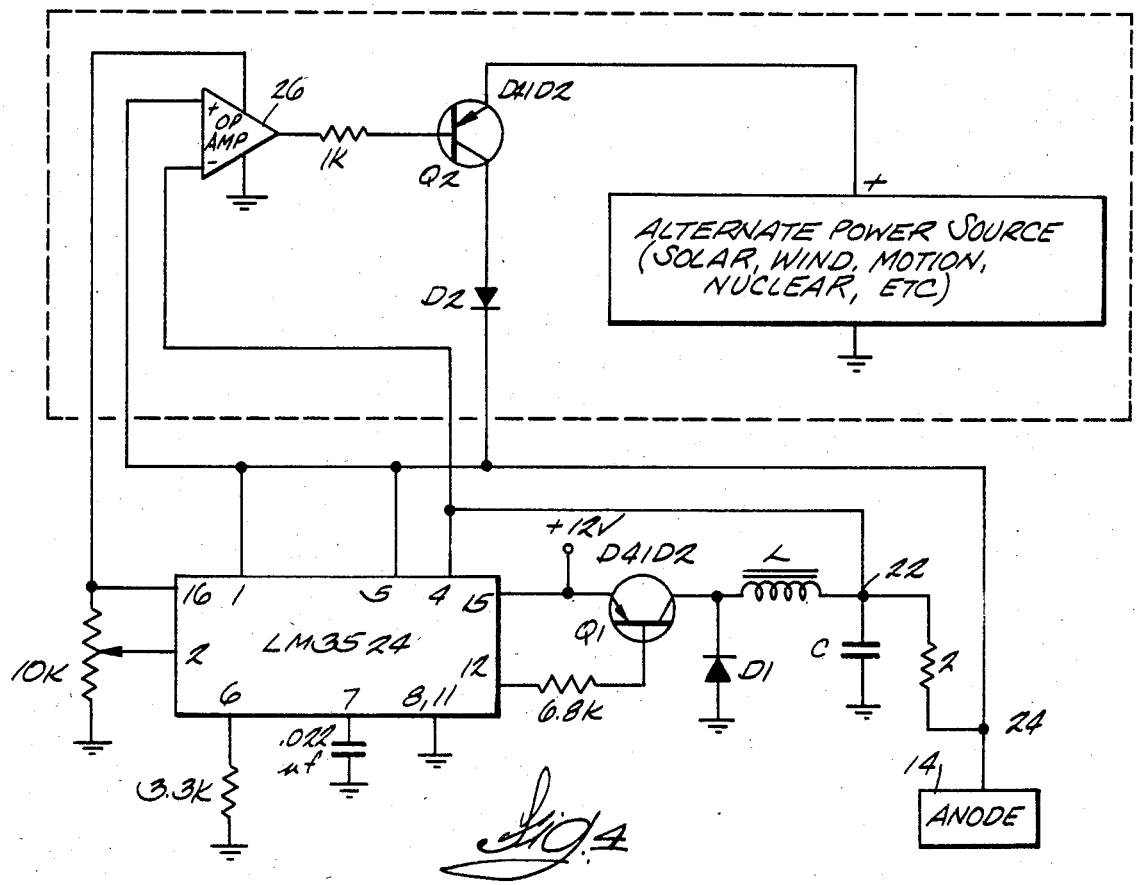
FIG. 4 shows how the chip is connected to supply a constant voltage to the anode which must have very constant surface characteristics. The circuit portion enclosed in dotted lines is optional and permits use in connection with an alternate power source.

FIG. 4 illustrates a circuit which applies a constant voltage to the anode. Such a circuit can be used with an anode which has a very constant surface characteristic such as a carbon anode. Within the dotted lines at the upper portion of FIG. 4 is an optional hook-up permitting use of the basic circuit with an alternate power source such as a solar cell, wind and motion detectors, nuclear, etc. which do not produce at all times. Considering just the basic circuit outside the dotted lines, it will be noted that the voltage at junction 24 is now applied to pin 1 of the error amplifier, while pin 2 has a constant supply determined by the setting of the potentiometer to which pin 2 is connected. As before, the voltage drop across the 2 ohm current sensing resistor is applied to pins 4 and 5 of the current limiting amplifier. With this arrangement, a constant voltage will be applied to junction 24 and anode 14.

If it is desired to prolong life of the boat battery (between charges) through use of an alternate power source the circuit shown inside the dotted lines in FIG. 4 is connected to the basic circuit shown in FIG. 4. With this arrangement, the voltage applied to anode 14 is also applied to the non-inverting (+) input of the operational While the inverting input (−) amplifier (op amp) 26 while the inverting input (−) of the op amp is connected to junction 22. Therefore, the voltage drop across the current sensing resistor is applied across the op amp. As the LM3524 power converter calls for more current, the voltage drop across the 2 ohm resistor causes the op amp inverting input to become more positive than the non-inverting input so the op amp turns on and becomes a sink. If the alternate source is active, the sink current goes through $Q_2$ and the 1 kohm resistor to the op amp and to ground through the op amp ground connection. The sink current turns on transistor $Q_2$ and current is supplied to the anode 14 from the alternate source through diode $D_2$.

Because the op amp has a high gain, very little current from the boat battery is necessary to provide nearly all the required current from the alternate source. If the alternate source is not active, the current will be supplied from the battery through the switching converter. If the voltage applied to the anode becomes too high, the LM3524 will stop supplying current and the voltage drop across the 2 ohm current sensing resistor will drop to zero. This in turn will cause the op amp to shut down and turn off transistor $Q_2$ and thus stop the current coming from the alternate source. Normally the LM3524 will reduce or regulate current from the alternate source. The control of current from the alternate source is not strictly an on-off situation. The LM3524 normally regulates the alternate source.

Other converters can be used such as a D.C. to D.C. converter of the type having an oscillator working through a transformer with the transformer output then rectified. Another could be a D.C. chopper or a switching regulator. Such systems provide an output voltage proportional to the time the switching converter in "ON". There are other possible arrangements.

We claim:

1. An impressed current cathodic protection system, said system comprising a structure to be protected, and a cathodic protection circuit connected to said structure and including an anode, a battery generating an output current, switching type dc-to-dc power converter means connected to said battery to receive the output current thereof and having an output with a current greater than the output current received from said battery, and an LC circuit connected between said output of said power converter means and said anode.

2. A system according to claim 1 including means regulating the voltage applied to said anode.

3. A system according to claim 2 in which said regulating means includes a half cell.

4. A system according to claim 3 in which the half cell is more noble than the structure.

5. A system according to claim 3 in which the half cell is less noble than the structure.

6. A system according to claim 2 including an alternate source of polarized electric power which is active at various times, switch means connecting said alternate power source to said anode, and means controlling said switch means to connect said alternate source to said anode if the alternate source is active, said power converter means being operative to supply to the anode the current not supplied by the alternate source and required by said anode.

7. A system according to claim 6 including means for regulating said alternate source to decrease or interrupt voltage supply to said anode from said alternate source in accordance with anode requirements.

8. A system according to claim 6 including a resistor in the circuit ahead of the anode, said means controlling said switch means being responsive to the voltage drop across said resistor.

9. A system according to claim 8 in which said switch means is a transistor and said controlling means is an operational amplifier connected as a sink to the base of said transistor.

10. An impressed current cathodic protection system comprising an object to be protected, and a cathodic protection circuit connected to said object and including an anode, a battery, and means including a switching type dc-to-dc power converter connected between the battery and the anode for supplying more current and less voltage to the anode than taken from the battery.

11. A system according to claim 10 including means regulating said power converter to supply a desired voltage to the anode relative to a reference voltage.

12. A system according to claim 10 including an LC circuit connected between the power converter and the anode, and a resistance connected between the LC circuit and the anode.

13. A system according to claim 12 including an alternate polarized power source which is operational at various times, a transistor connected between said alternate power source and said anode, said transistor being controlled by an operational amplifier connected to the base of said transistor and having its inputs connected across said resistor so said operational amplifier becomes a sink and said transistor turns on if the alternate power source is operative.

14. A system according to claim 13 in which said power converter includes means operative if the anode voltage is too high to stop current supply to said resistor to thereby turn off said operational amplifier.

* * * * *